US005833513A

United States Patent [19]

Llorens

[11] Patent Number: 5,833,513

[45] Date of Patent: Nov. 10, 1998

[54] CRAWLING AND MOVEMENT SIMULATING DOLL THAT MAKES WAKING UP AND FALLING ASLEEP GESTURES

[75] Inventor: Jaime Ferri Llorens, Onil, Spain

[73] Assignee: Onilco Innovacion S.A., Onil, Spain

[21] Appl. No.: 777,210

[22] Filed: Dec. 27, 1996

[30] Foreign Application Priority Data

Dec. 27, 1995 [ES] Spain ..... 9502530

[51] Int. Cl.[6] ..... A63H 13/00; A63H 11/00; A63H 3/36

[52] U.S. Cl. ..... 446/354; 446/352; 446/337

[58] Field of Search ..... 446/299, 302, 446/354, 337, 330, 352, 356, 175

[56] References Cited

U.S. PATENT DOCUMENTS

| | | | |
|---|---|---|---|
| 3,364,618 | 1/1968 | Ryan et al. | 446/302 X |
| 3,475,856 | 11/1969 | Cowell et al. | 446/299 |
| 4,717,364 | 1/1988 | Furuikawa | 446/175 |
| 4,775,352 | 10/1988 | Curran et al. | 446/299 X |
| 4,923,428 | 5/1990 | Curran | 446/299 X |
| 5,201,638 | 4/1993 | Ferri | 446/299 |

FOREIGN PATENT DOCUMENTS

| | | | |
|---|---|---|---|
| 704415 | 2/1965 | Canada | 446/299 |
| 61-21104 | 6/1986 | Japan | 446/354 |
| 1229688 | 4/1971 | United Kingdom | 446/356 |
| WO 91/10491 | 7/1991 | WIPO | 446/299 |

*Primary Examiner*—John A. Ricci
*Assistant Examiner*—D. Neal Mair
*Attorney, Agent, or Firm*—Ladas & Parry

[57] ABSTRACT

Crawling and movement simulating doll that makes waking up and falling asleep gestures, comprising a mechanism located inside a body make of resilient material which incorporates a doll's head and is provided with mechanisms acting on the eyes and mouth, the internal mechanism generating a plurality of movement and sound stages as a result of the direct action of a battery-powered motor on the mechanism, thereby causing a rhythmic action of said mechanism for moving the head and arms and for providing the crawling action, acting according to specified stages through internal contactors in cooperation with the parts comprised in the mechanism.

16 Claims, 5 Drawing Sheets

CRAWLING AND MOVEMENT SIMULATING DOLL THAT MAKES WAKING UP AND FALLING ASLEEP GESTURES

OBJECT OF THE INVENTION

This specification relates to an invention patent application concerning a crawling and movement simulating doll that makes waking up and falling asleep gestures, the obvious object thereof being to provide a doll internally fitted with a battery-operated mobile part drive mechanism also fitted with a sound emitter accompanying the doll's movements and gestures in the course of pre-established emission-lacking stages.

FIELD OF THE INVENTION

This invention is applicable to the doll manufacturing industry.

BACKGROUND OF THE INVENTION

The applicant acknowledges the existence at present of a plurality of dolls capable of performing various activities based on mechanisms incorporated inside the doll, said mechanisms being driven by battery-activated motors or hand winding.

Various other dolls are known to be internally fitted with sound, phrase and song emitting mechanisms, all of them being provided with battery driven playing records.

For mobility of the dolls, various mechanical assemblies are located in specific areas and are interconnected in order to provide harmonious action and the required effect based on emission-lacking established stages.

However, the applicant is not aware of the existence of a doll capable of crawling and simultaneously simulating other movements, among them the possibility of harmoniously making face gestures deriving from internally located mechanism and which generates, in a compact manner, the various movement possibilities on different parts of the doll assembly.

DESCRIPTION OF THE INVENTION

The crawling and movement simulating doll that makes waking up and falling asleep gestures proposed by the invention constitutes in itself an evident novelty within this field of application, the doll being provided with a compact mechanism that provides movement to all the mobile areas of the body based on the use of a single motor which drives the various internal springs, connecting rods and wheels.

More specifically, the crawling and movement simulating doll that makes waking up and falling asleep gestures of the invention is made up of a doll body, manufactured of any suitable material and normally comprising a semi-flexible plastic head incorporating movable eyes and an adequate hair covering, which head is coupled onto the upper area of the mechanism assembly and is retained therein, the mechanism being located in the internal area of a body manufactured from spongy material which is subsequently covered by a garment, generally pajamas or an overall, which covers the whole body, including the legs and arms, and which is attached by conventional means to the upper area of the central mechanism composed of the compact assembly and forms a kind of bag inside of which is installed, apart from the mechanism which activates the various mobile parts of the doll, the sound mechanism and the battery container.

In its resting position, the doll presents an attitude of laying on its arms, with its head tilted to one side.

In order to provide motion to the doll, the user strikes the doll with a slight spank on the backside area, thereby activating the movement mechanism driving the doll from its resting position, namely laying face down in a sleeping attitude with its head partially resting on its arms and tilted sideways, with closed mouth and eyes, upon acting on a trigger switch which opens the battery-fed circuit which initiates the cycle and emits a yawning sound through an electronic voice, said mechanism also being capable of emitting punctual and harmonic laughter, breathing and joyous sounds.

It must be noted that the breathing sound is maintained continuously until the user closes the general switch feeding the sound mechanism and cuts the power supply to the emitter, which consequently remains silent regardless of the fact that it is capable of continuously emitting a breathing sound while the rest of the mechanism is inactive.

Once the trigger switch is activated, the motor driving the motion circuit generates a gradual movement of the eyes and mouth and activates the yawning voice, subsequently starting a gradual raising of the body by the movement of the arms on which the head is resting, simultaneously rotating the head and raising the trunk.

As previously stated, the legs and backside totally lack movement and remain static at all times until the head is facing forwards, at which time, and based on the commands of the internal mechanism, a translation movement commences which originates from the arms and produces a dragging motion of the body, followed by head movement until the doll is back in its initial position, with a new movement of the head and arms, and moves down towards the resting position, the head laying on the arms and the doll becoming silent, although a sound emission simulating breathing is maintained at all times.

The mechanism assembly comprises two lateral extensions wherein are located the arm attachment elements.

Several fully defined zones are provided inside the internal mechanism, the upper side of which is configured in a practically cylindrical shape from which derives the mouth gesture driving mechanism emerging laterally and activated from the inside in an opening movement or vertical raising and lowering motion followed by opposite movements simulating the opening of the mouth in a yawning attitude, while from the upper part emerges a centrally hollow element which rotates when so commanded to produce movement of the connecting rod attached to the eyes, generating a raising an lowering motion which results in the opening and closing of the eyes, all these movements being performed in a rhythmic manner.

The central area or cylindrical core contains, in the upper part thereof, a cover inside of which appears the end of an eccentric wheel driven by a pinion which on being moved in one direction or the other generates the facial gestures of the doll.

In the upper area of the above mechanism cover, contactors are provided which form a circular area separated by isolated areas and over said contactors runs the part providing eye motion, with the corresponding acting contacts.

In the internal zone of said three contact areas, a circular base sheet is fitted which works in harmonic cooperation with the external contacts to generate the above movement.

In the internal area of the upper core are installed the various mechanisms providing movement to the mouth and eyes, which naturally cooperate with the above mentioned mechanisms which are directly responsible for physically acting on the parts attached to the lips and eyes.

As a fundamental working part in the mechanism, aside from the wheels and pinions, a part having a circular shape is provided which is fitted with two curved extensions whereby, on moving over the supporting part when the spring is motionless and in a resting position, the spring is activated and acts on the doll to maintain its breathing sound, subsequently being connected, while the doll remains motionless although the mouth and eyes are moving, to a third stage in which the doll starts to rise in response to the action of the spring, which also moves the head.

DESCRIPTION OF THE DRAWINGS

In order to complete this description and to help in providing a better understanding of the characteristics of the invention, attached to this specification and forming an integral part thereof is a set of drawings wherein the following is represented in an illustrative and non-limiting character.

PREFERRED EMBODIMENT OF THE INVENTION

Figure 1:
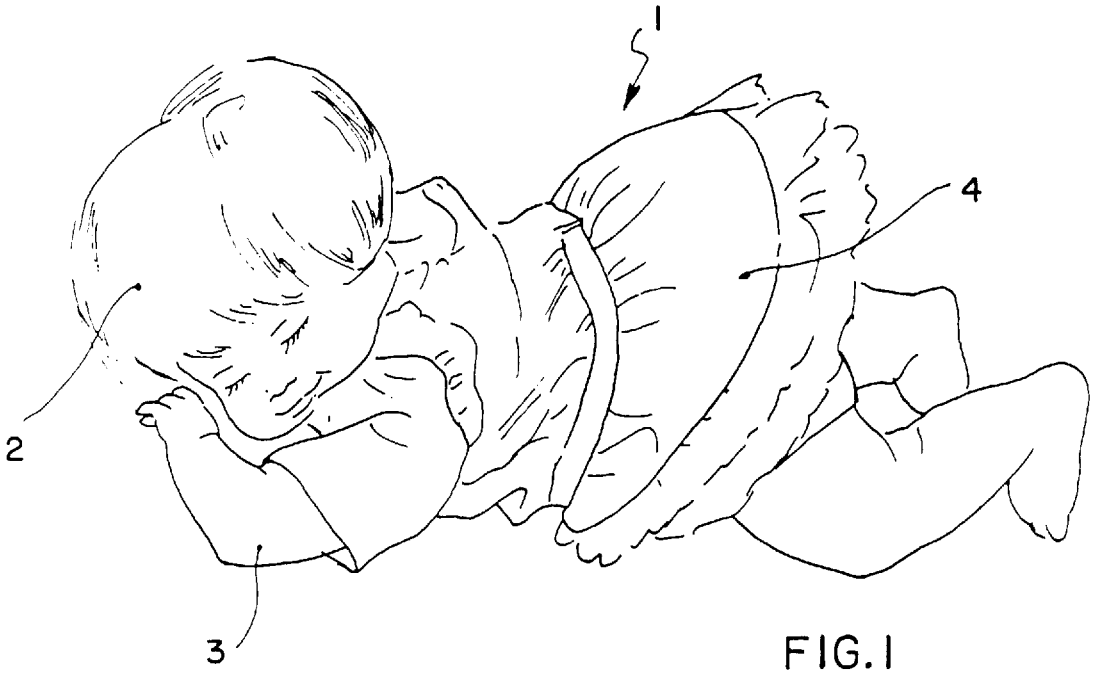
FIG. 1 shows a perspective view of a crawling and movement simulating doll that makes the waking up and falling asleep gestures object of the present invention, the doll being in a resting position.

As shown in FIG. 1, the crawling and movement simulating doll that makes waking up and falling asleep gestures (3) is formed as a doll comprising a head (2), arms (3) and body (4) from which the lower extremities (no reference numbers provided) extend.

In FIG. 1, the doll is shown in an initial position wherein the head (2) is lightly resting on the arms (3), the eyes and mouth being closed.

Figure 2:
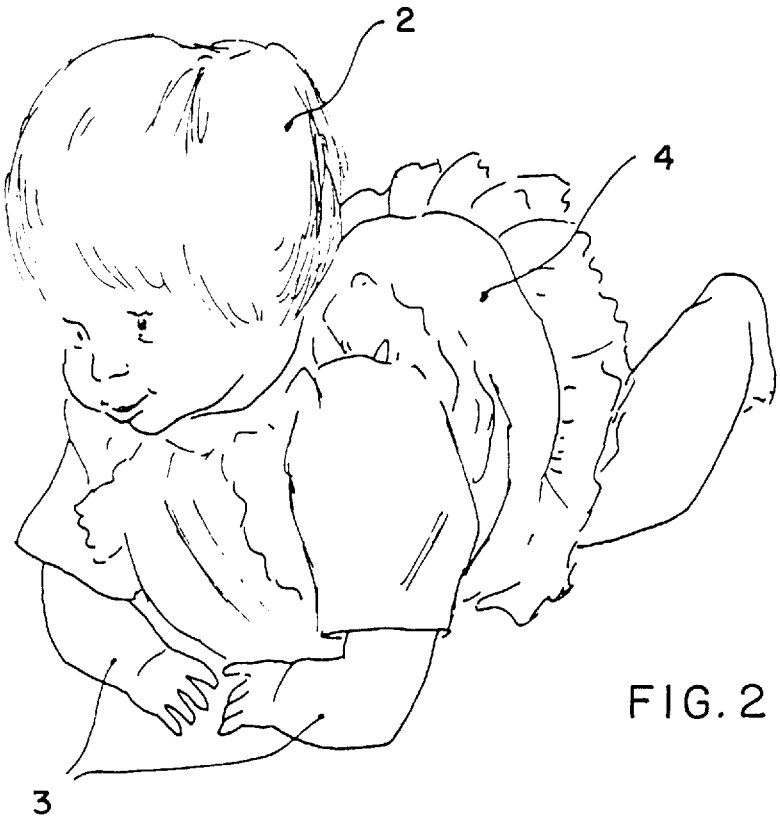
FIG. 2 shows a view of the object shown in FIG. 1, in a movement initiating position.

However, on proceeding to FIG. 2, it can be seen that the doll (1)—after a strike or spank on the buttock by the user, which activates a switch initiates a movement that gradually reaches the position shown in FIG. 2 wherein the head (2) is raised, the eyes and mouth are open, the arms (3) are leaning down and the body is in a position in which, as the arms (3) move, the doll is dragged along.

Figure 3:
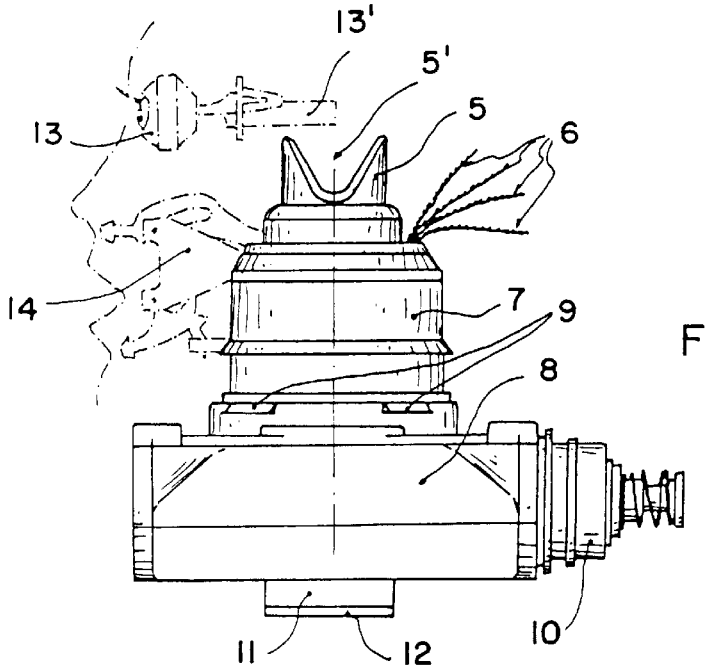
FIG. 3 shows a front elevation view of the crawling doll movement assembly as it works directly on the doll's eyes, mouth and arms.

FIG. 3 shows how the head (2) of the doll (1) is positioned over a single block body comprising several zones, and specifically in the upper portion of the general housing, an element (5) can be seen which, viewed from the front, is provided with a central recess (5') the movement of which causes the tilting of the eyes (13) as a result of it acting directly on the end (13') of the eyes (13) and which, on entering recess (5'), causes the opening of the eyes (13) and when positioned in the upper zone of the part (5) ends causes the closure of the eyes.

Inside the body of the housing, direct action mechanisms are fitted which act on the parts which form an assembly (14) embedded, at the ends thereof, in the upper and lower parts of the mouth this assembly by its backward motion or raising/lowering in a vertically rising and lowering movement of said ends timely causing gesturing the opening or closing of the mouth's facial area.

The overall mechanisms are fed by cables (6) connected to batteries, as is a sounding mechanism designed to emit various sound stages depending on the doll's position in the course of its movement.

The central zone is provided with a circular area forming a cylinder fitted with flanges (9) in the lower end thereof onto which a bag or pouch covering the doll's body, which constitutes the dolls's garment, is attached.

The lower zone (8) is incorporates arm motion mechanisms. The arms are fitted at the ends (10), onto which they are attached.

The lower part of zone (8) is provided with a sliding connecting rod which through its movement simultaneously generates arm driving stages for raising or lowering the arms, consequently acting as an element that via the connecting rod (12) enables motion in a rising or lowering direction of said arms (3), changing the rotation direction and consequently acting on the basis of the orders provided by said sliding connecting rod (12).

Figure 4:
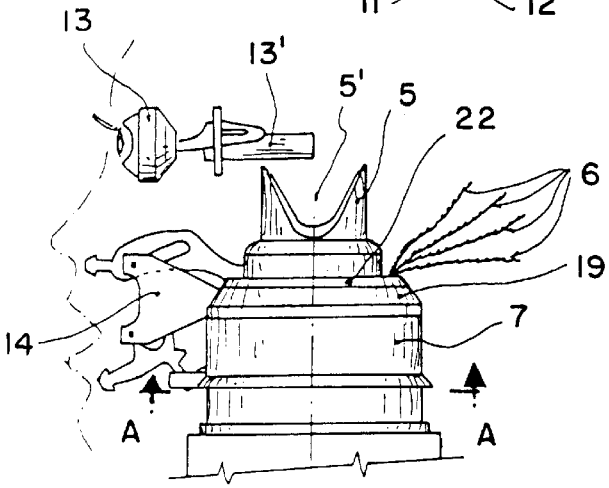
FIG. 4 shows an external side view of the upper area of the mechanism shown in FIG. 3, revealing details of the doll's lips and eyes driving mechanism.

FIG. 4 reveals how the central part of mobile element (5), located in the upper portion of area (7), is fitted with a recess (5') into which penetrates the shank (13') attached to the eyes (13), thereby allowing the eyes to open and close depending on the raising or lowering motion over said area (5') or the ends (5).

The fact acting mechanism which produces the movement of the mouth and lips (14) is activated from inside the body (7); for this purpose, under part (5) is a truncated cone area (19), the inner part of which has an eccentric wheel (20) which, on moving, acts directly on the sliding part, causing mechanism (14) to move.

Figure 5:
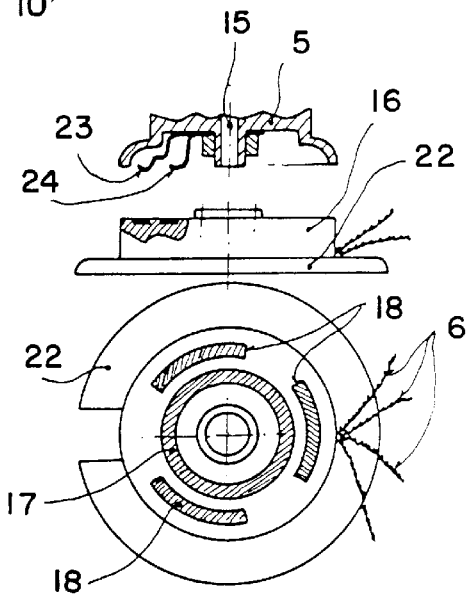
FIG. 5 shows a plan, partially sectioned front view of the upper area of the object shown in FIG. 4, wherein the part acting directly on the eye moving shank has been removed.
Figure 6:
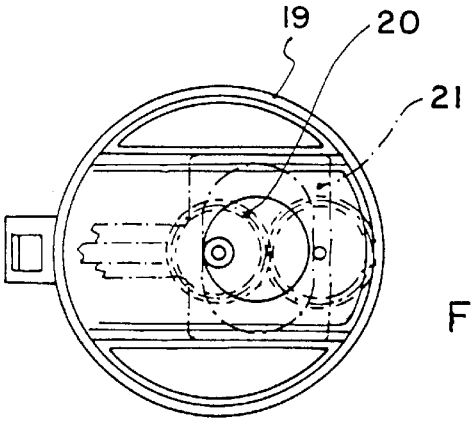
FIG. 6 shows a view along A—A of the object shown in FIG. 4.

FIG. 5 shows how the upper portion of the truncated cone area (19) is fitted with a disk-shaped element (22), as shown in said FIG. 5, which is provided with three spaced apart contactors (18) and one central contactor (17), onto which contactors are connected the terminals (23) and (24) which thus produce a rhythmical motion of the parts.

Figure 7:
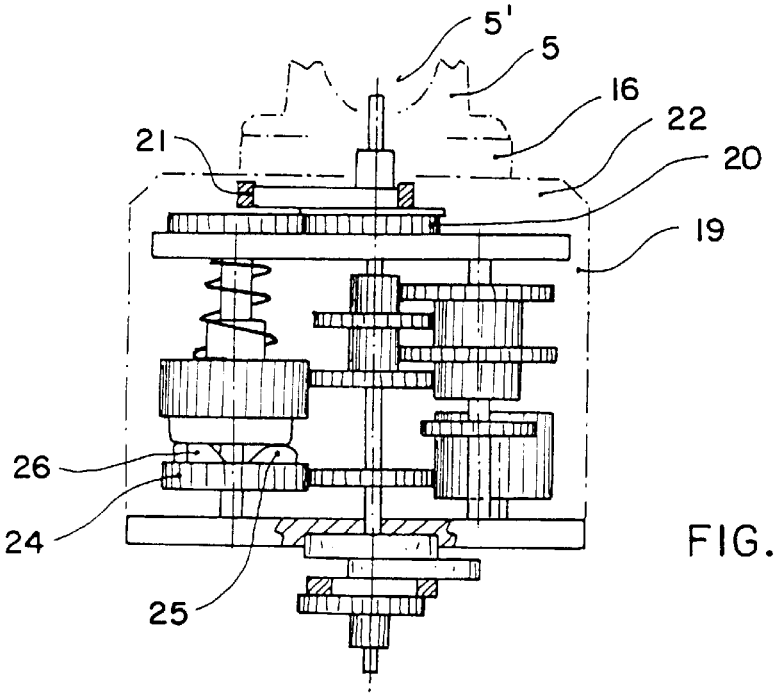
FIG. 7 shows a view of the motion mechanism's central block, specifically wherein the mouth and eye motion mechanism is incorporated.
Figure 8:
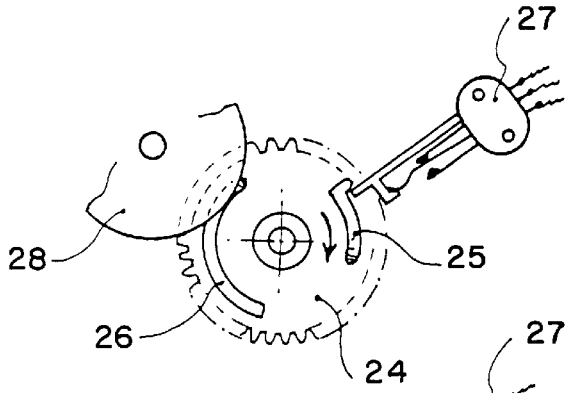
FIG. 8 is a plan, resting position view of the spring which generates activity in the doll as a result of lack of emission.
Figure 9:
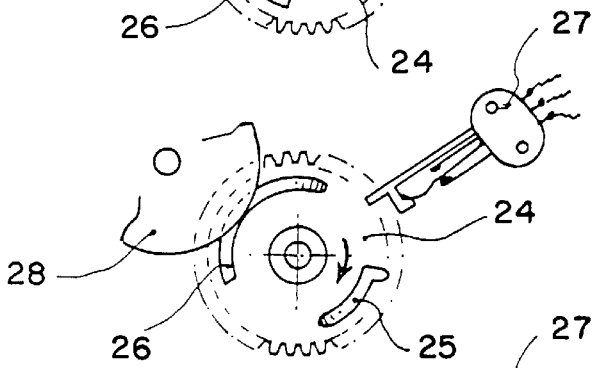
FIG. 9 shows the spring shown in FIG. 8 at such time as the spring connects the mouth and eye motion mechanism, although the arms remain at rest.
Figure 10:
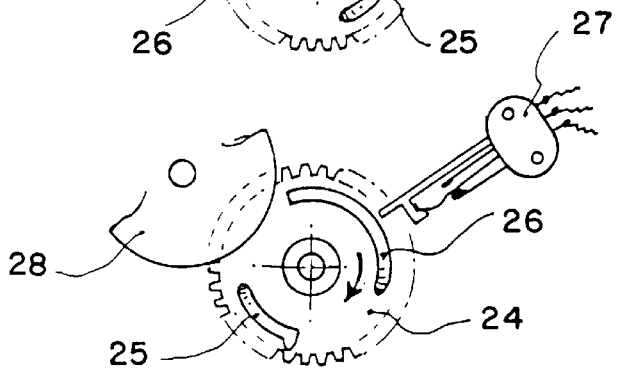
FIG. 10 again shows the spring shown in FIGS. 8 and 9 at such time as the doll starts to rise and move its head.

FIG. 7 shows the movement of the mouth and eyes, a spring loaded clutch assembly (24) being provided that is fitted with two curved and vertically positioned extensions (25) and (26) which act as a clutch on the parts (27) and (28), thus providing different actions to the doll, as can be seen graphically in FIGS. 8, 9 and 10.

FIG. 8 shows that the contactor element (27), fitted with an extension, acts directly on projection (25), whereas part (28) acts on projection (26), enabling the spring to be motionless and at rest, although the doll is breathing.

In FIG. 9, part (27) has been released from the action of projection (25) of clutch assembly (24) and thus projection (26) moves simultaneously with projection (25), thereby partially releasing part (28) and consequently making the doll to be connected and devoid of movement, although the mouth and eyes are moving.

FIG. 10 again shows part (27) in its released condition, wherein the mouth and eyes continue to move as a result of their being released from the emerging area (26) of clutch assembly (24) and also in view that part (28) is also free from the action of projection (25) and projection (26), whereby the doll, in addition to breathing and moving its eyes and mouth, starts to gradually rise, while moving its head.

Figure 11:
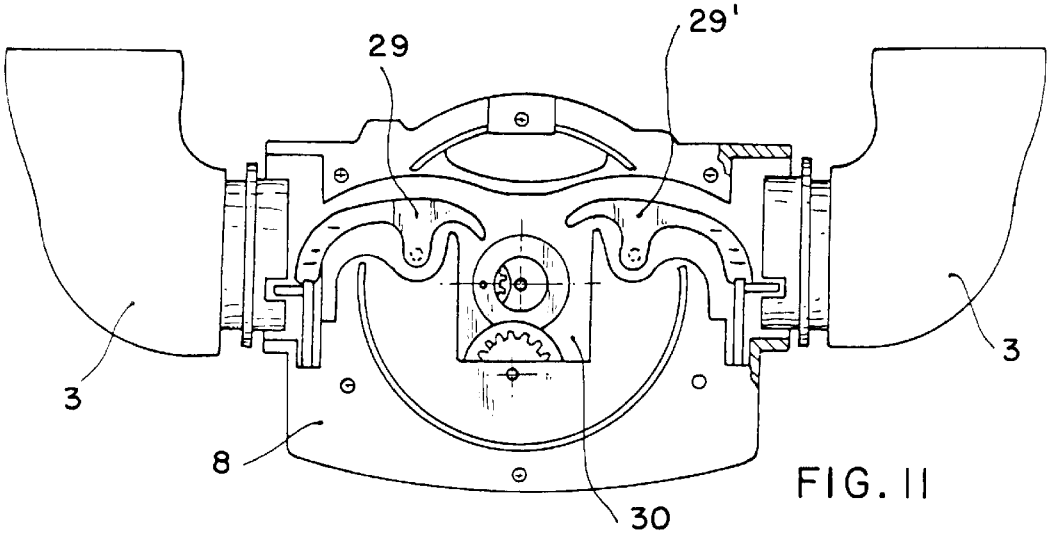
FIG. 11 shows a plan view along the upper zone of the lower body of the motion assembly.

FIG. 11 shows the upper zone of area (8) of the general housing, revealing the existence of two parts (29) and (29') which are moved by a quadrangular shaped part attached to a lower gear located in cell (30), the orders from this part enabling the arms to become disengaged and thus to start their rotational movement.

Figure 12:
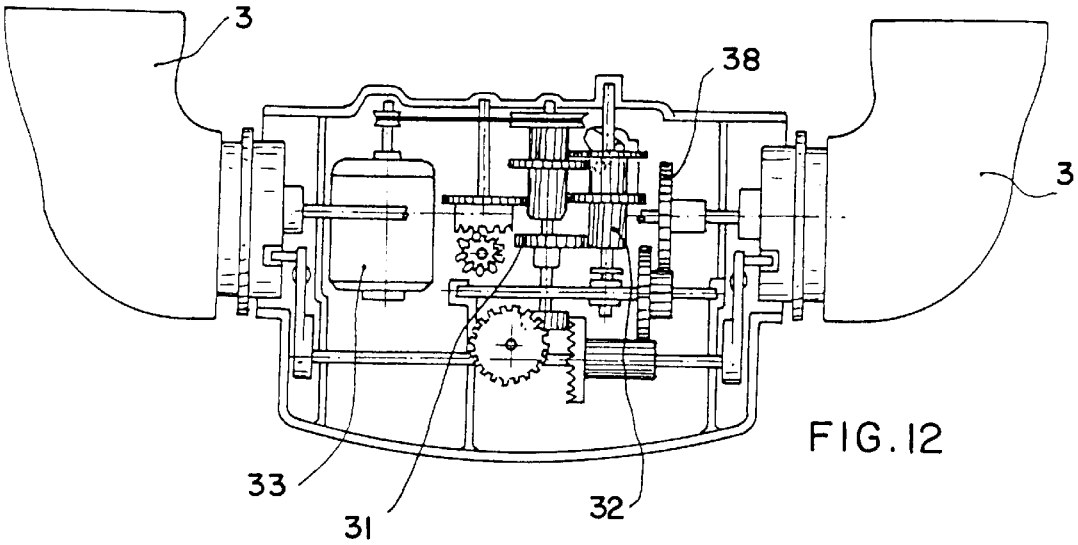
FIG. 12 shows a sectioned side elevation view of the object shown in FIG. 11 at such time as the doll starts to rise and ends the crawling cycle.
Figure 13:
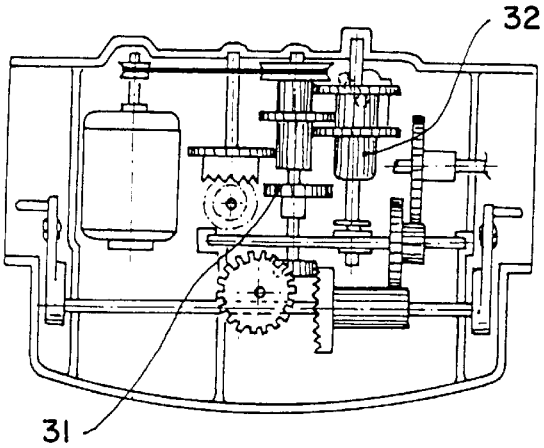
FIG. 13 is a view similar to the view shown in FIG. 12, in a resting position.

As the arms become disengaged, FIG. 12 shows that as a result of the movement which drives gear (31) over assembly (32), driving power is transmitted and the doll consequently starts moving its arms (3); it should be borne in mind that the whole assembly is powered by motor (33), this FIG. 12 also showing the start of the arm motion to lift the doll and the end of the crawling cycle.

Figure 14:
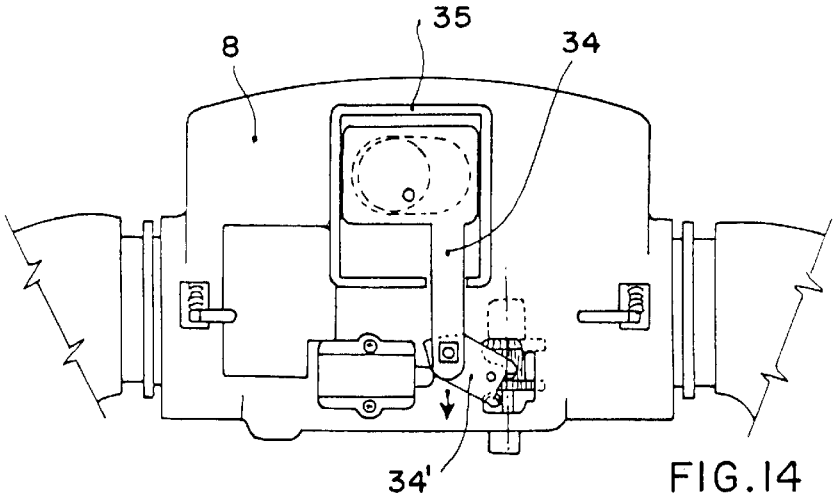
FIG. 14 shows a view along the lower zone of the object shown in FIGS. 11, 12 and 13 at such tim as the doll is resting.

FIG. 14 shows the assembly body (8) viewed from the lower area, in a resting position, this figure also showing how connecting rod (34) is thus positioned to make the doll motionless.

This part (34) moves along guides (35) formed as a projection having a quadrangular shape, and as a result of its movement acts directly—through its projection (34+)—on the wheels that provide motion to the arm mechanism.

Figure 15:
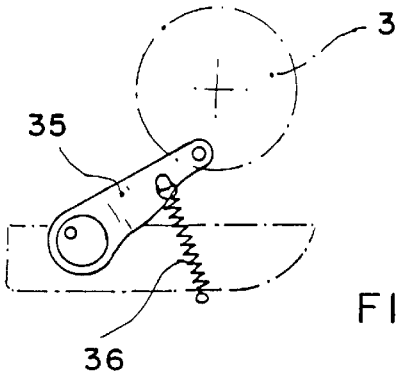
FIG. 15 shows the mechanism acting in cooperation with the arm to help in the movement thereof, formed by a connecting rod and a spring.

FIG. 15 shows how arm (3) is implemented by a movable lever (35) which cooperates with spring (36) to act directly on arm (3) for maintaining an adjusted position.

Figure 16:
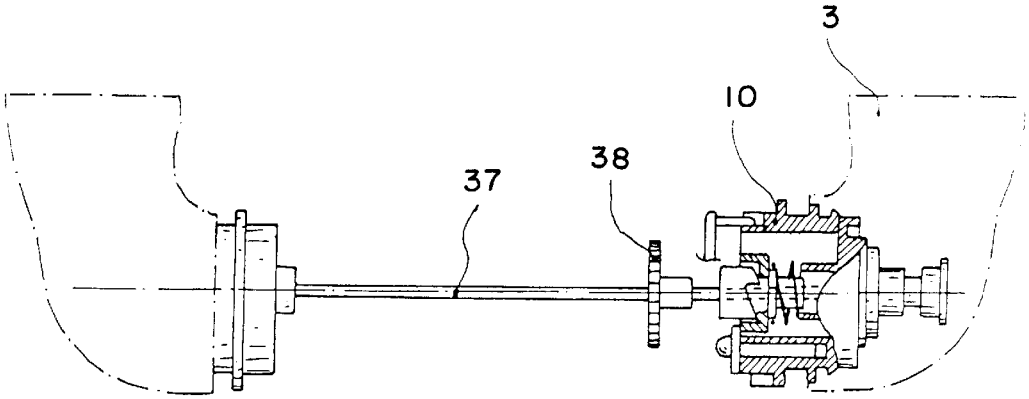
FIG. 16 shows a plan view of the arm support and joint shaft, each arm having an arm attachment mechanism incorporated.

Finally, FIG. 16 shows shaft (37), the ends of which include arm attachment elements (10), the arms being adhered to element (10), this element (10) assembly being fitted onto each end of shaft (37) and being supported by an implementing spring pawl and other conventional elements which act as required in order that said parts (10) are properly attached to shaft (37), which is to be immobilized through the mechanism as a result of its acting directly on pinion (38).

This description need not be more extensive for any expert on the subject to understand the scope of the invention and the advantages deriving therefrom.

The materials, form, shape and disposition of the elements are liable to variation provided no alteration on the essential nature of the invention is involved.

The terms in which this specification is described should at all times be addressed in their broad, non-limiting sense.

I claim:

1. A crawling and movement simulating doll that makes waking up and falling asleep gestures, of the type comprising a head (2) with eyes (13), a mouth, and lips, arms (3) and a body (4) from which derives lower extremities, internally provided with a switch which is activated by the user after spanking or striking a buttocks in the doll's (1) body, characterized in that an internally located mechanism assembly is incorporated in a housing fitted with an upper part (5) having a central recess which, upon moving in a circular direction, produces a tilting of the eyes (13) as a result of direct action on an end (13') of a part which constitutes an eye (13) mechanism, said recess (5') being entered by a shank or end (13'), emerging inside the recess, thus generating an opening of the eyes, or else when it positions itself in an upper zone of the upper part (5), the shank generating an opposite reaction, assembly (14) being equally connected which forms a mouth motion mechanism for the mouth, the internally located mechanism assembly being powered by batteries connected to cables (6), as is a sound mechanism which emits various sound stages based on preset movement positions of the doll (1), a central area being provided with a body (7) and a circular area forming a cylinder fitted with flanges (9) on a lower portion of which is attached a bag or pouch covering the doll's (1) body (4) and which provides a garment, for the doll, a lower area (8) having a sliding connecting rod which, via movement, simultaneously produces activity stages in the arms in order to raise or lower the arms, simultaneously acting as a motion element in a rising or lowering direction of the arms (3) through a connecting rod (12) formed in the shape of a sliding connecting rod which generates orders for changing the rotational direction of the arms (3) and of the eye mechanism and gesturing with movements of the mouth and lips (14), the inside of the body (7) being provided with an eccentric wheel (20) which upon moving acts directly on a sliding part that generates movement in the mouth motion mechanism (14), the doll (1) being provided with various sounds.

2. A crawling and movement simulating doll that makes waking up and falling asleep gestures, according to claim 1, characterized in that the central area and the upper part are joined by a truncated cone part (19) having an upper portion, the upper portion of part (19) being fitted with a part (22) having a surface, three contractors (18) on the surface that are separated from one another, and a central contractor (17), onto which are connected terminals (23) and (24) which by way of their contacts generate rhythmic movement, the mechanism assembly providing movement of the mouth and eyes and being fitted with an element (24) having two curved and vertically positioned projections (25) and (26) which act as a clutch on parts (27) and (28), thereby generating various actions on the doll (1).

3. A crawling and movement simulating doll that makes waking up and falling asleep gestures, according to claim 1, characterized in that said internally located mechanism assembly includes a spring loaded clutch assembly (24) having a first projection and a second projection, a contactor (27) with an extension acting directly on the first projection (25) and a clutch part (28) acting on the second projection (26), thus causing the spring loaded clutch assembly to be motionless and resting although the doll is simulating a breathing sound.

4. A crawling and movement simulating doll that makes waking up and falling asleep gestures, according to claim 3, characterized in that the contactor (27) is released from the first projection (25) as the second projection (26) is simultaneously put in motion, partially releasing clutch part (28) and thereby connecting the doll's mouth and eyes and moving them together with their mechanisms (13) and (14), the extremities of the doll remaining motionless, and the doll emitting a laughing sound.

5. A crawling and movement simulating doll that makes waking up and falling asleep gestures, according to claim 3, characterized in that when the contactor (27) is fully released, the eye (13) mechanism and the mouth motion mechanism (14) continue to move while the doll (1) starts to rise gradually, moving its head sideways and also moving its eyes and mouth while emitting sounds.

6. A crawling and movement simulating doll that makes waking up and falling asleep gestures, according to claim 1, characterized in that the lower area (8) of the doll has an upper zone, the upper zone of the lower area (8) being provided with two parts (29) and (29') which are moved by a quadrangular part attached to a lower gear located in a cell (30) of the lower area, thereby causing the arms to become disengaged and to start rotational motion.

7. A crawling and movement simulating doll that makes waking up and falling asleep gestures, according the claim 1, characterized in that, the lower area (8) of the doll has a gear assembly (32) and a gear (31) mounted therein, such that when the arms (3) become disengaged, a movement which impels gear (31) on gear assembly (32) transmits a driving force which causes the arms (3) to move, allowing the doll's arms to be fully raised, the internally located mechanism assembly being driven by a motor (33).

8. A crawling and movement simulating doll that makes waking up and falling asleep gestures, according to claim 1, characterized in that the doll is fitted with a connecting rod (34) which causes the doll to stop or become immobilized, said connecting rod running on guides (35) formed by a projection of a quadrangular shape, the connecting rod, upon moving, acting directly through an extension (34) on wheels that provide motion to the arms.

9. A crawling and movement simulating doll that makes waking up and falling asleep gestures, according to claim 1, characterized in that the arms (3) are implemented by a movable lever (35) which, in cooperation with a spring (36), act directly on the arms (3) in order to maintain an adjusted position.

10. A crawling and movement simulating doll that makes waking up and falling asleep gestures, according to claim 1, characterized in that the arms (3) are attached to a shaft (37), the ends of which are fitted with elements (10) onto which the arms are directly attached with the use of a pawl, implementing springs for proper attachment of the arms to the shaft (37), the arms being directly driven by a mechanism acting on a gear (38) associated with the shaft.

11. A crawling and movement simulating doll comprising a body portion having arms, legs and a head attached thereto, said head having movable eyes and movable lip portions, said doll further comprising:

means responsive to a trigger for generating a gradual movement of the eyes and mouth and simulteneously a translational movement of said arms, said arms providing means for producing a dragging motion of the body of said doll from an at rest position wherein the head of the doll is juxtaposed adjacent the arms thereof to a raised position wherein the body of the doll is at least partially supported by the arms and wherein the arms are moved away from the head of the doll.

12. The crawling and movement simulating doll according to claim 11, wherein the means for generating a gradual movement of the eyes and mouth and a translational movement of said arms comprises an internally located mechanism assembly driven by a motor, the mechanism assembly having an eye motion assembly for generating movement of the eyes and a mouth motion assembly for generating movement of the mouth.

13. The crawling and movement simulating doll according to claim 11, wherein the internally located mechanism assembly generates gradual movement of the eyes and mouth without generating translational movement of the arms.

14. The crawling and movement simulating doll according to claim 11, wherein the internally located mechanism assembly generates gradual movement of the eyes and mouth accompanied by translational movement of the arms.

15. The crawling and movement simulating doll according to claim 11, wherein the mechanism assembly initially generates a gradual movement of the eyes and mouth, followed by a translational movement of the arms.

16. The crawling and movement simulating doll according to claim 11, wherein the internally located mechanism assembly includes a rotating part driven by the motor, the rotating part having a plurality of contacts disposed thereon, one or more of the plurality of contacts selectively contacting at least one terminal as the rotating part is rotated, thereby generating movements of parts of the doll in a rhythmic manner.

* * * * *